US005364522A

United States Patent [19]

Wang

[11] Patent Number: 5,364,522

[45] Date of Patent: Nov. 15, 1994

[54] BORIDE, CARBIDE, NITRIDE, OXYNITRIDE, AND SILICIDE INFILTRATED ELECTROCHEMICAL CERAMIC FILMS AND COATINGS AND THE METHOD OF FORMING SUCH

[76] Inventor: Liang Wang, 5129 Maddox Rd., Tallahassee, Fla. 32303

[21] Appl. No.: 35,424

[22] Filed: Mar. 22, 1993

[51] Int. Cl.[5] ..... C25D 5/50; C25D 3/02

[52] U.S. Cl. ..... 205/50; 205/108; 205/224; 205/118; 205/229; 208/162; 208/174; 208/316; 428/446; 428/689; 428/688; 428/698; 428/704

[58] Field of Search ..... 205/59, 106, 108, 224, 205/229, 118, 174, 316, 162; 428/446, 689, 688, 698, 702

[56] References Cited

U.S. PATENT DOCUMENTS 4,882,014 2/1988 Coyle ..... 204/1.5

FOREIGN PATENT DOCUMENTS 0042715 12/1981 European Pat. Off. ..... 205/316

OTHER PUBLICATIONS

Chemical Abstracts, vol. 54, p. 187, Abs. #124792p.
Chemical Abstracts, vol. 64, p. 10898, Abs. #10898a.
Chemical Abstracts, vol. 105, p. 292, Abs. #119573r.
Chemical Abstracts, vol. 89, p. 538, Abs. #137658c.
Chemical Abstracts vol. 93, p. 256, Abs. #119055g.
Science, 1992, 258, 1918–1921.
J. Electrochem. Soc., 1991, 138, 1038–1040.
Electrochim. Acta, 1992, 37, 2421–2426.
Nature, 1992, 357, 395–397.
J. Electrochem. Soc., 1991, 138, 1643–1645.
J. Electrochem. Soc., 1992, 139, 67–69.
J. Electrochem. Soc., 1980, 127, 2053–2057.
Chem. Abstracts; vol. 57–Ceramics; p. 265; Abst. 119066g.

*Primary Examiner*—Kathryn Gorgos

[57] ABSTRACT

Ceramic films and coatings, single or multi-layered, including superlattice, infiltrated with boride, carbide, nitride, oxynitride, and silicide were formed by methods which comprises of an electrochemical coating of a ceramic precursor by a constant or an amplitude-modulated electric current with a DC component in a medium containing at least one of the ionic species for the composition of the ceramic precursor, following single or multiple infiltration in a medium containing at least one of the compounds selected from a B-containing compounds, a C-containing compounds, a N-containing compounds, a Si-containing compounds, and a mixture thereof, by heating means selected from radio-frequency, microwave, thermal, flame, plasma, laser, and a mixture thereof.

24 Claims, No Drawings

BORIDE, CARBIDE, NITRIDE, OXYNITRIDE, AND SILICIDE INFILTRATED ELECTROCHEMICAL CERAMIC FILMS AND COATINGS AND THE METHOD OF FORMING SUCH

BACKGROUND OF THE INVENTION

1. Field of Invention

This invention relates to a method for the formation of infiltrated electrochemical ceramic films and coatings, and specifically to boride, carbide, nitride, oxynitride, and silicide infiltrated ceramic films and coatings by an electrochemical ceramic precursor coating and then following an infiltration.

2. Cross-Reference to Related Applications

Boride, carbide, nitride, oxynitride, and silicide infiltrated ceramic films and coatings by an electrochemical ceramic precursor coating and then following infiltration are unknown.

DISCUSSION OF PRIOR ART

The electrochemical processes are known in the art of converting an anode parent metal to oxide films in the anodization processes: (Bengough & Stuart, British Patent No. 223,994; Military Specification MIL-A-8625, Anodic Coatings for Aluminum and Aluminum Alloys; Aerospace Material Specification AMS 2468A, Hard Coating Treatment of Aluminum Alloys), which have been developed for aluminum, magnesium, zinc, titanium, and some other metals.

The processes that are known in the art of oxide ceramic powders, or films, and or coatings by electrochemical deposition of a hydroxide precursor, and then following a high temperature sintering are in the following three methods:

(I) cathodic deposition in an aqueous dilute acid solution, and then following a sintering: Switzer (Am. Ceram. Soc. Bull., 1987, 66, 1521) and Coyle et al. (U.S. Pat. No. 4,882,014) deposited metal ions in a cathodic compartment. Slezak & Wieckowski (J. Electrochem. Soc., 1991, 138, 1038) deposited hydroxide of ions (Y, Ba, Cu). Hidetaka et al. (Electrochim. Acta, 1992, 37, 2421) deposited oxyhydroxide film of ions (La, Ca or Sr, Cr). Mitchell & Wilcox (Nature, 1992, 357, 395) deposited aluminum and magnesium hydroxides on a palladium cathode; (II) anodic deposition in a dilute alkaline solution, and then following a sintering: Switzer et al. (Science, 1990, 247, 444; 1992, 258, 1918) deposited lead-thallium-oxygen system; (III) cathodic deposition in a non-aqueous acidic solution, and following a sintering: Mackey & Segundo (U.S. Pat. No. 4,094,750) cathodically deposited oxide coating in an isopropanol solution, Bhattacharya et al. (J. Electrochem. Soc., 1991, 138, 1643; 1992, 139, 67) deposited ceramic precursor of ions (Y, BA, Cu) in dimethyl sulfoxide solution.

The processes are known in the art of infiltration of oxides to nitrides and oxynitrides in the following methods:

Jean Claude Gilles (Rev. Hautes Temp. Refractaires, 1965, 2, 237) oxynitridated oxides of metals (Zr, Ti, V, Hf, Nb, Al, Ga, Ge) with $NH_3$, or with C, $H_2$ reduction in $N_2$ or $NH_3$. Guidotti et al. (U.S. Bur. Mines, Rep. Invest. 1975, RI 8079) nitridated oxides of metals (Nb, V, Ta) with $NH_3$. Ikeda et al. (Yogyo Kyokaishi, 1985, 93, 108) nitridated zirconium oxide powder with metal Mg under nitrogen at 1000° C. Guyader et al. (Fr. Demande FR 2,571,041 Apr 1986) nitridated $Al_2O_3$ (1$\mu$) with $NH_3$ at 500° C. Ito et al. (J. Electrochem. Soc., 1980, 127, 2053) nitridated of $SiO_2$ film with $NH_3$ at 900° C.

A common drawback of oxide ceramic films or ceramic coatings obtained either by an anodization or by sintering of an electrochemical deposited ceramic precursor is that it has low mechanical strength and low corrosion resistance. It is well known that borides, carbides, nitrides, oxynitrides, and silicides inhere high mechanical strength and corrosion resistance. However, a process for obtaining a film or coating with borides, or carbides, or nitrides, or oxynitride, and or silicides is very difficult and very expensive.

OBJECTS AND ADVANTAGES

Accordingly, an object of the present invention is to provide a method for economically fabricating large scale of homogeneous planar and nonplanar ceramic films and coatings infiltrated by boride, or carbide, or nitride, or oxynitride, or silicide, and or a mixture thereof.

The advantage of this invention are:

(I) To provide infiltrated ceramic films and coatings having high tensile strength, and hardness. The surfaces of the invented films and coatings are exceptional durable against abrasion, friction, and scratching.

(II) To provide the infiltrated ceramic films and coatings having high chemical stability and pinholeless. The surfaces of infiltrated films and coatings have excellent anticorrosion in concentrated acids, alkalis, salts, organic solvents, sea water, and severe atmospheres, alone or in combination. The infiltrated coatings have excellent antifouling and nonwetting properties.

(III) To provide the infiltrated ceramic films and coatings having high thermal conduction in combined with excellent electric insulation.

(IV) To provide the infiltrated ceramic films and coatings having both high electric and thermal conductivities.

(V) To provide infiltrated ceramic films and coatings have properties of the safest biomaterials.

(VI) To provide homogeneous multilayered and superlattice infiltrated ceramic films and coatings have unique electro-optic, piezoelectric, piezo-optical, photochemical, microwave resonant, dielectric, electrodes for fuel cell, and semiconductive properties.

(VII) To bring the heating temperatures much lower than known processes for ceramic films.

(VIII) To fabricate infiltrated ceramic films and coatings with complicated geometric shapes.

SUMMARY OF THE INVENTION

According to a first aspect of the present invention, there is provided a method for the formation on a substrate, a single layered ceramic coating infiltrated with boride, or carbide, or nitride, or oxynitride, or silicide, and or a mixture thereof, in which the method comprises: (I) electrochemical coating of a ceramic precursor by a constant electric current with a direct current component in a medium containing at least one of the ionic species for the composition of the ceramic precursor; and (II) following a single or multiple step infiltration in a medium by heating means.

According to a second aspect of the present invention, there is provided a method for the formation on a substrate a multi-layered, including superlattice, ceramic coating infiltrated with boride, or carbide, or nitride, or oxynitride, or silicide, and or a mixture thereof, in which the method comprises: (I) electrochemical coating of a ceramic precursor by an amplitude-modulated electric current with a direct current component in a medium containing at least one of the ionic species for the composition of the ceramic precursor; and (II) following a single or multiple step infiltration in a medium by heating means.

According to a third aspect of the present invention, there is provided a method for the formation of a single layered ceramic film infiltrated with boride, or carbide, or nitride, or oxynitride, or silicide, and or a mixture thereof, in which the method comprises: (I) on a conductive substrate with an insulation material on one face and electrochemical coating on the other face with a ceramic precursor by a constant electric current with a direct current component in a medium containing at least one of the ionic species for the composition of the ceramic precursor; (II) remove said insulation material; (III) following a single or multiple step infiltration in a medium by heating means; and (IV) remove said substrate.

According to a forth aspect of the present invention, there is provided a method for the formation of a multi-layered, including superlattice, ceramic film infiltrated with boride, or carbide, or nitride, or oxynitride, or silicide, and or a mixture thereof, in which the method comprises: (I) on a conductive substrate with an insulation material on one face and electrochemical coating on the other face with a ceramic precursor by an amplitude-modulated electric current with a direct current component in a medium containing at least one of the ionic species for the composition of the ceramic precursor; (II) remove said insulation material; (III) following single or multiple step infiltration in a medium by heating means; and (IV) remove said substrate.

DETAILED DESCRIPTION OF THE INVENTION

In the invention by "boride, carbide, nitride, oxynitride, and silicide infiltrated ceramic films and coatings" is meant, those obtained by this invented method and containing reaction infiltrated compounds selected from boride, carbide, nitride, oxynitride, silicide, and a mixture thereof. The concentration of the infiltrated compounds have a maximum at surface and gradients which decreases exponentially with depth.

The first method for the formation of a single, or multi-layered, including superlattices, ceramic coating infiltrated with boride, or carbide, or nitride, or oxynitride, or silicide, and or a mixture thereof, on a conductive substrate is which the method comprises: (I) electrochemical coating of a ceramic precursor on the substrate by a constant or an amplitude-modulated electric current or a potential waveform having a direct current component, and with constant or modulated frequencies in a medium containing at least one of the ionic species for the composition of the ceramic precursor; and (II) heating the ceramic precursor on the substrate in a medium containing at least one of the compounds selected from the group consisting of boron-containing compounds, carbon-containing compounds, nitrogen-containing compounds, silicon-containing compounds, and a mixture thereof, by a heating mean selected from a group consisting of radio-frequency heating, microwave heating, thermal heating, flame heating, plasma heating, and laser heating.

The second method for the formation of a single, or multi-layered, including superlattices, ceramic coating infiltrated with boride, or carbide, or nitride, or oxynitride, or silicide, and or a mixture thereof, on a conductive substrate is which the method comprises: (I) electrochemical coating of a ceramic precursor on the substrate by a constant or an amplitude-modulated electric current or a potential waveform having a direct current component, and with constant or modulated frequencies in a medium containing at least one of the ionic species for the composition of the ceramic precursor; and (II) sequentially heating the ceramic precursor on the substrate by heating means, first, in a medium containing at least one of the compounds selected from the group consisting of ammonia, chlorine, hydrogen, hydrocarbons, and a mixture thereof, and following in a medium containing at least one of the compounds selected from the group consisting of boron-containing compounds, carbon-containing compounds, nitrogen-containing compounds, silicon-containing compounds, and a mixture thereof, by a heating mean selected from a group consisting of radio-frequency heating, microwave heating, thermal heating, flame heating, plasma heating, and laser heating.

The first method for the formation of a single, or multi-layered, including superlattices, ceramic film infiltrated with boride, or carbide, or nitride, or oxynitride, or silicide, and or a mixture thereof, is which the method comprises: (I) on a conductive substrate with an insulation material on one face and electrochemical coating on the other face with a ceramic precursor by a constant or an amplitude-modulated electric current or potential waveform having a direct current component, and with constant or modulated frequencies in a medium containing at least one of the ionic species for the composition of the ceramic precursor; (II) remove said insulation material; (III) heating the ceramic precursor on the substrate in a medium containing at least one of the compounds selected from the group consisting of boron-containing compounds, carbon-containing compounds, nitrogen-containing compounds, silicon-containing compounds, and a mixture thereof, by a heating mean selected from a group consisting of radio-frequency heating, microwave heating, thermal heating, flame heating, plasma heating, and laser heating; and (IV) dissolve said substrate.

The second method for the formation of a single, or multi-layered, including superlattices, ceramic film infiltrated with boride, or carbide, or nitride, or oxynitride, or silicide, and or a mixture thereof, is which the method comprises: (I) on a conductive substrate with an insulation material on one face and electrochemical coating on other the face with a ceramic precursor by a constant or an amplitude-modulated electric current or potential waveform having a direct current component, and with constant or modulated frequencies in a medium containing at least one of the ionic species for the composition of the ceramic precursor; (II) removing said insulation material; (III) sequentially heating said ceramic precursor on said substrate by heating means first in a medium containing at least one of the compounds selected from the group consisting of ammonia, chlorine, hydrogen, hydrocarbons, and a mixture thereof, and following in a medium containing at least one of the compounds selected from the group consisting of boron-containing compounds, carbon-containing compounds, nitrogen-containing compounds, silicon-containing compounds, and a mixture thereof, by a heating mean selected from a group consisting of radio-frequency heating, microwave heating, thermal heating, flame heating, plasma heating, and laser heating; and (IV) removing said substrate.

Preferred materials for the substrate include transition metals, alloys, semiconductors, electrically conductive non-metals, conductive polymers, materials coated with metals, alloys, electrically conductive non-metals, semiconductors, and conductive polymers. The surface subject to the ceramic coating should be clean, active, free from grease and scale, and electrically conductive in electrolytes.

A substrate subject to anodic coating is direct current positively polarized. A substrate subject to cathodic coating is direct current negatively polarized. An external voltage is connected across the two electrodes, a DC, or a pulsed DC, or a sine wave DC, or a sawtooth DC, or a triangular DC, or a stepped DC, and or a mixture thereof is passed through the electrodes and electrolytes.

This invention relates that the preferred electric potentials or current waveforms consists of a pure DC, a pulsed DC, a sine wave DC, a sawtooth DC, a triangular DC, a stepped DC, a sine wave AC, and a mixture thereof.

This invention relates that the applied voltage and current are critical parameters to obtain high quality hydrous oxide and hydroxide ceramic precursors. This invention relates to the discovery that a preferred DC current density should be controlled between 0.01 $mA/cm^2$–5.0 $A/cm^2$ based on the coated substrate area. If the applied voltage is below a deposition potential, the ceramic precursor coating will not yet occur. Increasing the applied voltage above a critical overvoltage will make the coating efficiency drop rapidly and the coated surface will become porous.

When a pulsed DC voltage, or a sine wave DC, or a sawtooth DC, or a triangular DC, or a stepped DC is applied, different ions will be coated at different potentials to form a layered ceramic precursor coating. A ceramic precursor composition with layered, laminal ultrastructures including superlattices are obtained by the modulating of the applied voltage or current. A multilayered, or laminal ultrastructures including a superlattice precursor coating can be obtained by the modulating of the applied voltage or current densities at the proper waveform or pulse frequency. An amplitude-modulated DC voltage or current density provides a finely controlled layered ceramic precursor composition. The invention also relates to the discovery that following an infiltration the multilayered and superlattice ceramic precursor coatings are infiltrated to multilayered and superlattice ceramic coatings having boride, carbide, nitride, oxynitride and silicide infiltrated concentration gradients with the maximum at surface and minimum in bulk of the parent ceramic coatings.

This invention found that the correct frequencies of an amplitude-modulated DC, or pulsed DC, or stepped DC for layered or superlattice coatings are the product of coating efficiency of an electrode, integrated DC current density at the selected ionic deposition potential range, and gram equivalent mass of the selected ion, divided by product of Faraday, the density of the selected ion, and the layer thickness or diameter of the selected ion. The potential amplitude of the amplitude-modulated DC, or pulsed DC, or stepped DC should cover the range of the deposition potentials of the ions interested.

The invention also relates to the discovery that the bath medium for anodic or cathodic coating can be selected from the group consisting of aqueous oxyacids, aqueous alkalis, fused salt electrolytes, hydroxylic solvents, polar aprotic solvents, colloid dispersion, and pastes. The bath medium must contain at least one of the ionic species for the deposition of ceramic precursor. The preferred oxyacids are carbonic acid, carboxylic acid, chloric acid, chromic acid, iodic acid, nitric acid, perchloric acid, periodic acid, phosphoric acid, selenic acid, silicic acid, sulfuric acid, and telluric sulfamic acid. The preferred alkalis are amines, ammonium hydroxide, lithium hydroxide, potassium hydroxide, and sodium hydroxide. The preferred fused salt electrolytes are metal fluorides, metal chlorides, and metal oxides. The preferred hydroxylic solvents are alcohols, tetrahydrofuran, and amines. The preferred polar aprotic solvents are acetonitrile, alkylketones, N,N-dimethylacetamide, N,N-dimethylformamide, dimethyl sulfoxide, ethylene carbonate, formamide, hexamethylphosphoramide, N-methylacetamide, and N-methylformamide, and alkylamides. The preferred colloid dispersion or pastes are the medium containing at least one of colloid or solid species of an inorganic compound wherein at least one of the metal-containing cationic species having metal species selected from the group consisting of alkaline earth metals, lanthanides, transition metals, representative metals, and wherein at least one of the anionic species is selected from the group consisting of aluminate, amide, antimonate, antimonide, arsenate, arsenide, aurate, azide, beryllate, bismuthate, bismuthide, boranate, borate, boride, bromate, cadmate, carbide, carbonate, chlorate, chromate, cobaltate, cuprate, cyanate, dichromate, dimolybdate, diphosphate, dithionate, ferrate, germanate, hafnate, hydroxide, iodate, manganate, mercurate, molybdate, nickelate, niobate, nitrate, nitride, nitrite, oxide, oxynitride, palladate, perchlorate, periodate, phosphate, phosphide, platinate, selenate, selenide, silicate, silicide, stannate, sulfate, sulfide, tantalate, tellurate, telluride, titanate, tungstate, vanadate, zirconate, and a mixture thereof. The alkaline earth metals are selected from the group consisting of Be, Mg, Ca, Sr, Ba. The lanthanides are selected from the group consisting of Y, La, Ce, Pr, Nd, Sm, Eu, Gd, Tb, Dy, Ho, Er, Tm, Yb, Lu. The transition metals are selected from the group consisting of Ti, Zr, Hf, V, Nb, Ta, Cr, Mo, W, Mn, Fe, Co, Ni, Pd, Pt, Cu, Ag, Au, Zn, Cd, Hg. The representative metals are selected from the group consisting of Al, Ga, In, Tl, Ge, Sn, Pb, Sb, Bi.

The invention relates to the discovery that the preferred metal-containing cationic species having metal species selected from the group consisting of alkaline earth metals, lanthanides, transition metals, representative metals, and a mixture thereof. The alkaline earth metals are selected from the group consisting of Be, Mg, Ca, Sr, Ba. The lanthanides are selected from the group consisting of Y, La, Ce, Pr, Nd, Sm, Eu, Gd, Tb, Dy, Ho, Er, Tm, Yb, Lu. The transition metals are selected from the group consisting of Ti, Zr, Hf, V, Nb, Ta, Cr, Mo, W, Mn, Fe, Co, Ni, Pd, Pt, Cu, Ag, Au, Zn, Cd, Hg. The representative metals are selected from the group consisting of Al, Ga, In, Tl, Ge, Sn, Pb, Sb, Bi. The preferred anionic species are selected from the group consisting of aluminate, amide, antimonate, antimonide, arsenate, arsenide, aurate, azide, beryllate, bismuthate, bismuthide, boranate, borate, boride, bromate, cadmate, carbide, carbonate, chlorate, chromate, cobaltate, cuprate, cyanate, dichromate, dimolybdate, diphosphate, dithionate, ferrate, germanate, hafnate, hydroxide, iodate, manganate, mercurate, molybdate, nickelate, niobate, nitrate, nitride, nitrite, oxide, oxynitride, palladate, perchlorate, periodate, phosphate, phosphide, platinate, selenate, selenide, silicate, silicide, stannate, sulfate, sulfide, tantalate, tellurate, telluride, titanate, tungstate, vanadate, zirconate, and a mixture thereof.

This invention relates that the deposited films of ceramic precursors have a high thickness homogeneity, but low mechanical strength, and contain hydrous hydroxides, hydrous oxides, and hydrous salts. Here the adjective hydrous implies that the water is loosely bounded in nonstoichiometric proportions. The ceramic precursors are highly unstable fine-grained nano-crystals with high lattice or surface potential energy and with great grain boundary surfaces.

The reactive conversions classified as boronization, carburization, nitridation, oxynitridation, and silicidation are utilized for infiltration of ceramic precursors.

This invention relates that a ceramic precursor coating to be infiltrated must be clean, and free from solution, solid particles and colloidal suspension, and free from adsorbed harmful ions. The clean surfaces can be dried by heating means. After it is rendered clean and dry, it must be kept in this state until it is infiltrated to a ceramic coating.

This invention relates to the discovery that the infiltration for an electrochemical deposited ceramic precursor is much faster than the conversion process for powders of metal oxides. The infiltration conversions for an electrochemical deposited ceramic precursor require much lower temperature and infiltrate much deeper than the powders of metal oxides. The infiltration process is a complex function of a reaction medium and heating temperature. Infiltration starts at 250° C. with dehydration, chemical reactions, thickness shrinkage, refractive index change, and a density increase. The heating period for achieving a percentage conversion depends on the temperature and the nature of the reaction medium selected. A higher temperature up to 600°–850° C. is necessary to achieve a greater degree of conversion of a ceramic precursor film and coating into a boride, carbide, nitride, oxynitride, and silicide infiltrated ceramic film and coating. The infiltration temperature of 600°–850° C. is 500°–300° C. lower than the temperature used in the conventional methods for reaction conversion of oxides to borides, or carbides, or nitrides, or oxynitrides, and or silicides. Depending on the ultrastructure of the ceramic precursor and the conversion process, two types of infiltration exist: (I) Single layer with infiltrated fine-grains ($<0.1$ $\mu$m) and with an infiltrated compound content decreasing exponentially with depth; (II) Two layers: a near surface layer with constant infiltrated compounds and with larger grains (1–2 $\mu$m), beneath which is a layer in which the infiltrated compounds decreases exponentially with depth. Higher temperatures and prolonged heating results in deeper infiltration and the grain growth of both the ceramic coating and substrate metals. Larger ceramic grains increase corrosion resistance, mechanical strenth, and high temperature stability due to a slower diffusion of oxygen via grain boundary.

This invention relates to the discovery that an infiltration can be accomplished in a gas stream selected from the group consisting of boron-containing compounds, carbon-containing compounds, nitrogen-containing compounds, silicon-containing compounds, and a mixture thereof.

This invention related to the discovery that alkylborans, boran-ammonia complexes, boran-alkylamine complexes, boran-alkyl sulfide complexes, boran-heterocyclic complex compounds, borazine, and a mixture of boron halides with hydrogen are preferred for the boronization of ceramic precursors; alkanes, alkenes, alkynes, specially acetylene, alkyl halides, alcohols, aldehydes, ketones, cycloalkenes, and aromatic hydrocarbons are preferred for the carburization of ceramic precursor; ammonia, alkyl amines, cycloalkyl amines, a mixture of nitrogen with hydrogen, and nitrogen are preferred for the nitridation and oxynitridation of ceramic precursors; alkylsilanes, alkylchlorosilanes, and cycloalkylchlorosilanes are precursors; alkylsilanes, alkylchlorosilanes, and cycloalkylchlorosilanes are preferred for the silicidation of ceramic precursors.

This invention relates to the discovery that the gas or vapor used must be carefully deoxygenated, because if the oxygen's partial pressure of the ceramic precursor treated is lower than the oxygen's partial pressure of the gas or vapor at the temperature, no infiltration will be expected. A freshly coated ceramic precursor is much more reactive than an aged ceramic precursor.

This invention relates to the discovery that an infiltration can be accomplished with these sequential steps: (I) the infiltration is under a gas stream selected from the group consisting of chlorine, reductive gases, such as hydrogen, hydrocarbons, and a mixture thereof, to a surface temperature between 250° to 800° C. by heating means; (II) following an infiltration in a gas selected from the group consisting of boron-containing compounds, carbon-containing compounds, nitrogen-containing compounds, silicon-containing compounds, and a mixture thereof, to a surface temperature between 250° to 800° C. by heating means.

This invention further relates to the discovery that a sequential heating starting with hydrogen, hydrides, or hydrocarbon provides a highly reactive surface for the infiltration. However, an excessive reduction of the ceramic precursor reduces the strength of the final coatings. Heating in chlorine also improves the surface reactivity, however, excessive chlorine treatment greatly reduces the ceramic/metal adhesion strength.

This invention relates to the discovery that an infiltration can be accomplished by an infiltration paste containing at least one of components selected from the group consisting of borides, carbides, nitrides, silicides, and a mixture with hydrides, graphite, metals, metal fluorides, metal chlorides, organoboron compounds, organometallic compounds, organosilicon compounds, and ureas, by a heating mean at the temperature of 250° to 800° C. under a gas stream.

This invention relates to the discovery that the infiltration processes promote the sealing of surface pinholes by a reaction with metal atoms, and therefore increase the anticorrosion.

This invention further relates to that a preferred heating mean is selected from a group consisting of radio-frequency heating, microwave heating, thermal heating, flame heating, plasma heating, and laser heating. Radio-frequency heating or microwave heating use radio-frequency or microwave energy absorbed by the coated surface and provides a homogeneous heating in a surface region. Thermal heating is selected from the treatment consisting of constant temperature, and programmed temperature heating. Flame heating is selected from the treatment consisting of direct flame contact, flame untouched, or infrared heating. Plasma heating is selected from the treatment consisting of nitrogen as a heating source and the heating energy is supplied by a high voltage arc struck between an anode and cathode within a specially designed nozzle. Laser heating is the procedure using $CO_2$ lasers or excimer lasers to convert the ceramic precursor to an infiltrated ceramic under a gas or a vapor by heating and photochemical reactions and providing the coated surface a local physical pattern.

This invention also relates to the formation of passivating coatings or top coatings for conductive ceramics. This invention further relates to the boride, carbide, nitride, and silicide infiltrated ceramic coatings whereby the top coating is prepared by CVD, plasma enhanced CVD, metal catalyzed CVD, physical vapor depositions, or the sol-gel method.

This invention relates to the application of boride, carbide, nitride, oxynitride, and silicide infiltrated ceramic coatings. The coatings can made for anticorrosion in concentrated acids, alkalis, salts, organic solvents, sea water, and severe atmospheres, alone or in combination. The coated surfaces can made for antiabrasion, antifouling, antifriction, nonwetting, electric insulation, electric conduction, alone or in combination. Those coatings can be used in chemical, petroleum, environmental, nuclear, energy, tool, transportation, automobile, construction, desalination, ship, and etc. industries.

This invention also relates to the application of the invented multilayered and superlattice boride, carbide, nitride, oxynitride, and silicide infiltrated ceramic films and coatings. These infiltrated ceramic films and coatings provide unique electro-optic, piezoelectric, piezo-optical, photochemical, microwave, photoferroelectric, dielectric, electrodes for fuel cell, and semiconductive properties. The invented tantalum, titanium, and zirconium multilayered and superlattice ceramic films and coatings can be used as the materials of electric, optical, optochemical, electro-optic, piezoelectric, piezo-optical, microwave, fuel cell electrode, dielectric, capacitors, and 3D memory devices.

This invention provides boride, carbide, nitride, and silicide infiltrated ceramic films and coatings which are among the safest biomaterials available and which are useful for coating implants in a living body, industries of food and pharmaceuticals, biological sciences, genetic technology, medical sciences, laboratory equipment, and etc.

PREFERRED EMBODIMENTS OF THE INVENTION

The invention is further illustrated by the following examples which are illustrative of the specific aspect of practicing the invention, and should not be taken as limiting the scope of the invention defined by the appended claims.

EXAMPLE 1

Solution A1 was prepared by dissolving zirconyl nitrate 0.55 g, yttrium nitrate 0.011 g, and lanthanum nitrate 0.34 g in 10 ml of water, following by mixing with 500 ml of M-methylacetamide. A porous ceramic coated on one face with nickel was dipped in a solution with 10% sodium metasilicate and 10% sodium hydroxide for 3–5 minutes, washed by water, dried, and served as cathode. The cathode was negatively polarized with Pt counter electrodes in solution A1 with the direct current density around 1.5 mA/cm$_2$ at room temperature for 18 hours. After drying the infiltration of the ceramic precursor was carried out in a 1 liter autoclave filled with 250 ml anhydrous-ammonia and 1 g of metal sodium. The autoclave was heated to 132° C. at 111 atm. for 1 hour. Sodium amide was formed as a intermediate. The treated sample was heated at 700°–750° C. for 15 minutes in nitrogen atmosphere. The formed coated surface had high tensile strength, antifriction, excellent corrosion resistance.

EXAMPLE 2

Solution B1 was prepared by mixing potassium tungstate 2.5 g, potassium hexafluorotitanate 1.3 g, cerium oxide 0.48 g, sodium tetraborate 26 g, sodium hydroxide 400 g, and 500 ml of water. Solution B2 was prepared by mixing tantalum chloride 1.2 g, lanthanum sulfate 0.26 g, samarium sulfate 0.28 g, chromium (VI) oxide 25 g, and 98% sulfuric acid 154 ml. This mixture was diluted to 500 ml with water. A hard chrome coated steel sample was positively polarized with Ni counter electrodes in solution B1 with the direct current density around 0.4–0.5 mA/cm$_2$ at room temperature for 16 hours. The infiltration was carried out with the surface temperature of 480°–500° C. for 2 hours in a 75% $H_2$ and 25% acetylene within a tube furnace. Then the coated sample was positively polarized with Ni counter electrodes in solution B2 with the direct current component around 0.2–0.3 mA/cm$_2$ at room temperature for 12 hours. The infiltration was carried out in a graphite tube furnace, first, under 10 torrs hydrogen for 2 hours and then under 5 torrs of triethylborane for 2 hours within the surface temperature range of 600°–650° C. The formed ceramic coatings had high tensile strength, antifriction, excellent corrosion resistance.

EXAMPLE 3

Solution B3 was prepared by mixing tantalum fluoride 0.21 g, strontium chloride 0.12 g, and 20 ml of water, and following by mixing with 980 ml of dimethyl sulfoxide. A mechanically polished chrome coated mild steel sample was dipped in a solution with 20% $HNO_3$ and 2% HF for 3–5 minutes, and then washed in water. The sample subject to a cathodic coating, was negatively polarized with Ni counter electrodes in solution B3 at room temperature. A pulsed DC voltage was used for coating. The DC current component was oscillated between 0.05 to 2 mA/cm$_2$. The coating was continued for 86 hours. The infiltration was carried out wherein a 500 MHz radio-frequency furnace first under 1 atm. hydrogen for 2 hours, and then following under a mixture of 6 torrs of ammonia and 2 torrs of $BCl_3$ for 6 hours. The surface temperature was among 750°–800° C. The formed ceramic coating had excellent acid and alkali corrosion resistance, and corrosion resistance for high temperature oxidation.

EXAMPLE 4

Solution E1 was prepared by mixing aluminum nitrate 0.38 g, and a freshly prepared 16% titanyl hydroxide 1.75 g, cerium oxide 0.33 g, strontium hydroxide 0.24 g, chromium (VI) oxide 1.4 g, 35% nitric acid 2 ml and acetic acid 25 ml. This mixture was diluted with 1000 ml 1-butanol. A mechanically polished aluminum sample was dipped in 38% $HNO_3$ and 6.5% HF solution for a 8–10 minutes and washed in deionized water. The sample was negatively polarized with Ni counter electrodes in a solution with a direct current component around 0.1–0.5 mA/cm$_2$ at room temperature for 26 hours. The sample was coated with 2–3 mm paste consisting of $B_4C$:Mg:$KBF_4$:NaF:borax:carbon black:poly(acrylonitrile):acetonitrile=2:2:4:1:10:1:2:20. After drying, the sample was subject to infiltration by nitrogen plasma heating at 500°–550° C. for 5–6 minutes. The formed ceramic coating had high tensile strength, oxidation and corrosion resistance at ≦600° C.

EXAMPLE 5

Solution E2 was prepared by mixing freshly prepared titanyl nitrate 0.19 g, lead nitrate 0.28 g, samarium nitrate-6-water 0.045 g, manganese nitrate-4-water 0.0051 g, 35% nitric acid 5 ml and acetic acid 20 ml, following dilution with 1000 ml N,N-dimethylacetamide. A polished 0.5 mm thick zinc sample coated on one face with poly(ethylene terephthalate), was dipped in a solution with 20% chromic acid and 1.5% sulfuric acid for a few minutes and washed in deionized water. The sample was negatively polarized with Ti counter electrodes in solution E2. A DC plus a pulsed DC voltage was used to coat the cathode. The total DC voltage was oscillated between −5 V to −0.2 V referred to Ag/AgNO3 electrode at room temperature. The coating was continued for 16 hours. Then the coating of poly(ethylene terephthalate) was removed by tetrahydrofuran. The infiltration was carried out in a 250 torrs of triethylboran in a Muffle furnace at 450°–500° C. for 1 hour. The sample was etched by 5% hydrochloric acid to remove zinc substrates. The finished sample was coated in a vacuum by tin oxide on both faces. The formed ceramic film showed excellent microwave resonance, piezoelectric, and piezo-optical properties.

EXAMPLE 6

Solution A2 was prepared by mixing zirconium oxide 0.24 g, silicon dioxide 0.30 g, calcium hydroxide 0.12 g, potassium hydroxide 350 g, and 500 ml of water. The mixture was heated to 100° C. for 1 hour and cooled to 60° C. A polished 316 stainless steel implant sample was dipped in 6.5% nitric acid and 0.5% HF solution for 4–6 minutes and washed in deionized water. The sample was positively polarized with Ni counter electrodes in solution A2. An applied amplitude-modulated pulsed DC voltage was used for deposition. The DC pulsed voltage oscillated between 70 mV to 6.5 V versus a saturated calomel electrode at 25° C. at the frequency of 30 Hz. The coating was continued for 72 hours. The infiltration was carried out in a mixed atmosphere of ammonia:nitrogen=1:2 in a Muffle furnace at 700°–750° C. for 2 hours. A part of the surface was dip coated with dialysed zirconia gels and followed a drying for two days. The stainless steel implant was subject to a programmed heating at the range of 450°–800° C. for 4 hours under a mixture of dichlorodimethylsilane and hydrogen. The formed ceramic coating showed strong antiabrasion, and anticorrosion properties.

EXAMPLE 7

Solution E3 was prepared by mixing titanyl nitrate 0.15 g, strontium hydroxide 0.24 g, praseodymium nitrate 0.46 g, cerium nitate 0.65 g, copper nitrate 0.37 g, 35% nitic acid 5 ml and acetic acid 25 ml. The mixture was diluted with 1000 ml of hexamethylphosphoric triamide. A polished and zincated manganese-aluminum alloy sample served as an electrode. The sample was negatively polarized with Ni counter electrodes in solution E3. An amplitude-modulated pulsed DC voltage was used to coat the cathode. The DC current densities were modulated between 0.01 to 0.75 mA/cm$^2$ at room temperature at the frequency of 20 Hz for 42 hours. The infiltration was carried out in a 2.45 GHz and 8 KW microwave furnace under 250 torrs of trimethylborane at 450°–500° C. for 2 hours. The formed ceramic coatings had a superlattice structure and showed unique properties of semiconduction, strong mechanical strength, and corrosion resistance.

EXAMPLE 8

Solution A3 was prepared by dissolving cadmium sulfide 0.25 g, silicon arsenate 0.47 g, phenyl sulfide 0.44 g, potassium hydroxide 0.012 g, in a mixture of 500 ml of N-methylacetamide, and 500 ml of tetrahydrofuran. A finely polished sapphire was CVD coated with a 0.25–0.30 micrometer of tin oxide and served as a sample. The sample was positively polarized with Pt counter electrodes in solution A3. An amplitude-modulated pulsed DC voltage was used for coating. The DC current densities was modulated between 0.005 to 0.06 mA/cm$^2$ with the frequency of 2 Hz. The anodic coating was continued for 78 hours. The infiltration was carried out in a 500 MHz 1 KW radio-frequency furnace under 50 torrs of triethylboran for 20 minutes at 520° C., and then following laser infiltration by a 200 W $CO_2$ laser with 40 MHz frequencies in nitrogen. The focused beams had power flux about 1000–10,000 W/cm$^2$. The top of the ceramic coating was coated by CVD with 0.25–0.30 micrometer of gold film. The formed ceramic coatings had a superlattice structure and showed unique properties of photoconductivity, photovoltaic, and electroluminescence.

EXAMPLE 9

Solution B4 was prepared by mixing titanium nitrate 0.060 g, manganese nitride 0.0014 g, samarium nitrate 0.019 g, lead nitrate 0.22 g, potassium hydroxide 5.0 g, and 10 ml of water, then diluted with a mixed solvent of 500 ml of tetrahydrofuran and 500 ml of diisopropylamine. The polished 316 stainless steel sample subject to anodic coating and was positively polarized with Ni counter electrodes in solution B4. The DC voltage was modulated between 70 mV to 6.0 V versus a saturated calomel electrode at 18° C. with a frequency of 26 Hz. The anodic coating was continued to 28 hours. The infiltration was carried out in a 2.45 GHz 8 KW microwave furnace under borazine:hydrogen=1:3 at 550° C. for 25 minutes. The formed ceramic coatings had superlattice structures and showed unique piezoelectric, and acoustoelectric properties.

EXAMPLE 10

Solution E4 was prepared by mixing titanium oxide 0.42 g, and copper sulfate 0.025 g, strontium sulfate 0.12 g, chromium (VI) oxide 2.5 g, and 98% sulfuric acid 154 ml. This mixture was diluted to 500 ml with water. A mechanically polished 316 stainless steel sample electrode was positively polarized with Ni counter electrodes in solution E4. The sample electrode was subject to anodic coating with a direct current component around 0.5 mA/cm$_2$ at room temperature for 96 hours. The coated sample was coated with 2–3 mm of paste consisting of urea:borax:glycerol:graphite:poly(acrylonitrile)=40:15:10:3:5. After drying, the infiltration was carried out by flame heating at 550°–650° C. in a nitrogen atmosphere for 25 minutes. The formed ceramic coatings had properties of scratch resistance, excellent corrosion resistance, antifriction, and antifouling.

Although the present invention has been described with respect to specific embodiments and examples thereof, various changes and modifications may be suggested to one skilled in the art. Therefore, it is intended that the present invention include any such changes and modifications as will fall within the scope of the invention as defined by the appended claims.

What is claimed is:

1. A method for forming on a conductive substrate, a single-layered or multi-layered ceramic coating that is infiltrated with at least one of the compounds selected from the group consisting of boride, carbide, nitride, oxynitride, silicide, and a mixture thereof, in which the method comprises: (A) immersing said substrate serving as an anode and a counter electrode serving as a cathode in a bath medium containing at least one of the ionic species to form a ceramic precursor; (B) forming said ceramic precursor on the surface of said substrate by supplying a constant or an amplitude-modulated electric voltage having a direct current component to said substrate serving as an anode and said counter electrode serving as a cathode; and (C) heating said ceramic precursor on said substrate by heating means in a medium containing at least one of the compounds selected from the group consisting of boron-containing compounds, carbon-containing compounds, ammonia, amines, urea, silicon-containing compounds, and a mixture thereof.

2. A method as claimed in claim 1 wherein said bath medium is selected from the group consisting of aqueous oxyacids, organic acids, aqueous alkalis, fused salt electrolytes, hydroxylic solvents, polar aprotic solvents, colloidal dispersions, pastes, and a mixture thereof.

3. A method as claimed in claim 1 wherein said ionic species are anions selected from the group consisting of aluminate, amide, antimonate, antimonide, arsenate, arsenide, aurate, azide, beryllate, bismuthate, bismuthide, boranate, borate, boride, bromate, cadmate, carbide, carbonate, chlorate, chromate, cobaltate, cuprate, cyanate, dichromate, dimolybdate, diphosphate, dithionate, ferrate, germanate, hafnate, hydroxide, iodate, manganate, mercurate, molybdate, nickelate, niobate, nitrate, nitride, nitrite, oxide, oxynitride, palladate, perchlorate, periodate, phosphate, phosphide, platinate, selenate, selenide, silicate, silicide, stannate, sulfate, sulfide, tantalate, tellurate, telluride, titanate, tungstate, vanadate, zirconate, and a mixture thereof.

4. A method as claimed in claim 1 wherein said heating mean is selected from the group consisting of radio-frequency heating, microwave heating, thermal heating, flame heating, plasma heating, laser heating, and a mixture thereof.

5. A method as claimed in claim 1, wherein said boron-containing compounds are organoboron, boranes, borazine, a mixture of boron halides and hydrogen, and a mixture thereof; wherein said carbon-containing compounds are alkanes, alkenes, alkynes, alkyl halides, cycloalkenes, aromatic hydrocarbons, and a mixture thereof; wherein said silicon-containing compounds are alkylsilanes, alkylchlorosilanes, cycloalkylsilanes, and a mixture thereof.

6. A substrate coated or undercoated by the method described in claim 1.

7. A method for forming on a conductive substrate, a single-layered or multi-layered ceramic coating that is infiltrated with at least one of the compounds selected from the group consisting of boride, carbide, nitride, oxynitride, silicide, and a mixture thereof, in which the method comprises: (A) immersing said substrate serving as a cathode and a counter electrode serving as an anode in a bath medium containing at least one of the ionic species to form a ceramic precursor; (B) forming said ceramic precursor on the surface of said substrate by supplying a constant or an amplitude-modulated electric voltage having a direct current component to said substrate serving as a cathode and said counter electrode serving as an anode; and (C) heating said ceramic precursor on said substrate by heating means in a medium containing at least one of the compounds selected from the group consisting of boron-containing compounds, carbon-containing compounds, nitrogen-containing compounds, silicon-containing compounds, and a mixture thereof.

8. A method as claimed in claim 7 wherein said bath medium is selected from the group consisting of aqueous oxyacids, organic acids, aqueous alkalis, fused salt electrolytes, hydroxylic solvents, polar aprotic solvents, colloidal dispersions, pastes, and a mixture thereof.

9. A method as claimed in claim 7 wherein said ionic species is a metal-containing cation having metal species selected from the group consisting of alkaline earth metals, lanthanides, transition metals, representative metals, and a mixture thereof; wherein said alkaline earth metals are selected from the group consisting of Be, Mg, Ca, Sr, Ba, and a mixture thereof; wherein said lanthanides are selected from the group consisting of Y, La, Ce, Pr, Nd, Sm, Eu, Gd, Tb, Dy, Ho, Er, Tm, Yb, Lu, and a mixture thereof; wherein said transition metals are selected from the group consisting of Ti, Zr, Hf, V, Nb, Ta, Cr, Mo, W, Mn, Fe, Co, Ni, Pd, Pt, Cu, Ag, Au, Zn, Cd, Hg, and a mixture thereof; wherein said representative metals are selected from the group consisting of Al, Ga, In, Tl, Ge, Sn, Pb, Sb, Bi, and a mixture thereof.

10. A method as claimed in claim 7 wherein said amplitude-modulated electric current is an electric current with a constant or time-variated waveform selected from the group consisting of a single pulse, a multiple pulse, a sine wave, a sawtooth, a triangular, a stepped shape, a convolution of different geometric shapes, and a mixture thereof.

11. A method as claimed in claim 7 wherein said heating means is selected from a group consisting of radio-frequency heating, microwave heating, thermal heating, flame heating, plasma heating, laser heating, and a mixture thereof.

12. A method as claimed in claim 7, wherein said boron-containing compounds are selected from the group consisting of organoboron, boranes, borazine, a mixture of boron halides and hydrogen, and a mixture thereof; wherein said carbon-containing compounds are selected from the group consisting of alkanes, alkenes, alkynes, alkyl halides, cycloalkenes, aromatic hydrocarbons, and a mixture thereof; wherein said nitrogen-containing compounds are selected from the group consisting of ammonia, alkyl amines, cycloalkyl amines, urea, sodium amide, a mixture of nitrogen and hydrogen, and a mixture thereof; wherein said silicon-containing compounds are selected from the group consisting of alkylsilanes, alkylchlorosilanes, cycloalkylsilanes, and a mixture thereof.

13. A method as claimed in claim 7 wherein said multi-layered ceramic coating includes a superlattice ceramic coating.

14. A substrate coated or undercoated by the method described in claim 7.

15. A device made by the method described in claim 7.

16. A method for forming a single-layered or multi-layered ceramic film, that is infiltrated with at least one of the compounds selected from the group consisting of boride, carbide, nitride, oxynitride, silicide, and a mixture thereof, in which the method comprises: (A) coating a conductive substrate with an electrically insulated layer on one face; (B) immersing said substrate serving as an electrode and a counter electrode in a bath medium containing at least one of the ionic species to form a ceramic precursor; (C) forming said ceramic precursor on the surface of said substrate by supplying a constant or an amplitude-modulated electric current having a direct current component to said substrate serving as an electrode and said counter electrode; (D) removing said electrically insulated layer from and substrate; (E) heating said ceramic precursor on said substrate by heating means in a medium containing at least one of the compounds selected from the group consisting of boron-containing compounds, carbon-containing compounds, nitrogen-containing compounds, silicon-containing compounds, and a mixture thereof; (F) removing said substrate.

17. A method as claimed in claim 16 wherein said bath medium is selected from the group consisting of aqueous oxyacids, organic acids, aqueous alkalis, fused salt electrolytes, hydroxylic solvents, polar aprotic solvents, colloidal dispersions, pastes, and a mixture thereof.

18. A method as claimed in claim 16 wherein said electrode is an anode, wherein said counter electrode is a cathode, wherein said ionic species are anions selected from the group consisting of aluminate, amide, antimonate, antimonide, arsenate, arsenide, aurate, azide, beryllate, bismuthate, bismuthide, boranate, borate, boride, bromate, cadmate, carbide, carbonate, chlorate, chromate, cobaltate, cuprate, cyanate, dichromate, dimolybdate, diphosphate, dithionate, ferrate, germanate, hafnate, hydroxide, iodate, manganate, mercurate, molybdate, nickelate, niobate, nitrate, nitride, nitrite, oxide, oxynitride, palladate, perchlorate, periodate, phosphate, phosphide, platinate, selenate, selenide, silicate, silicide, stannate, sulfate, sulfide, tantalate, tellurate, telluride, titanate, tungstate, vanadate, zirconate, and a mixture thereof.

19. A method as claimed in claim 16 wherein said electrode is a cathode, wherein said counter electrode is an anode, wherein said ionic species is a metal-containing cation having metal species selected from the group consisting of alkaline earth metals, lanthanides, transition metals, representative metals, and a mixture thereof; wherein said alkaline earth metals are selected from the group consisting of Be, Mg, Ca, Sr, Ba, and a mixture thereof; wherein said lanthanides are selected from the group consisting of Y, La, Ce, Pr, Nd, Sm, Eu, Gd, Tb, Dy, Ho, Er, Tm, Yb, Lu, and a mixture thereof; wherein said transition metals are selected from the group consisting of Ti, Zr, Hf, V, Nb, Ta, Cr, Mo, W, Mn, Fe, Co, Ni, Pd, Pl, Cu, Ag, Au, Zn, Cd, Hg, and a mixture thereof; wherein said representative metals are selected from the group consisting of Al, Ga, In, Tl, Ge, Sn, Pb, Sb, Bi, and a mixture thereof.

20. A method as claimed in claim 16 wherein said amplitude-modulated electric current is an electric current with a constant or time-variated waveform selected from the group consisting of a single pulse, a multiple pulse, a sine wave, a sawtooth, a triangular, a stepped shape, a convolution of different geometric shapes, and a mixture thereof.

21. A method as claimed in claim 16 wherein said heating means is selected from a group consisting of radio-frequency heating, microwave heating, thermal heating, flame heating, plasma heating, laser heating, and a mixture thereof.

22. A method as claimed in claim 16, wherein said boron-containing compounds are selected from the group consisting of organoboron, boranes, borazine, a mixture of boron halides and hydrogen, and a mixture thereof; wherein said carbon-containing compounds are selected from the group consisting of alkanes, alkenes, alkynes, alkyl halides, cycloalkenes, aromatic hydrocarbons, and a mixture thereof; wherein said nitrogen-containing compounds are selected from the group consisting of ammonia, alkyl amines, cycloalkyl amines, urea, sodium amide, a mixture of nitrogen and hydrogen, and a mixture thereof; wherein said silicon-containing compounds are selected from the group consisting of alkylsilanes, alkylchlorosilanes, cycloalkylsilanes, and a mixture thereof.

23. A method as claimed in claim 16 wherein said multi-layered ceramic film includes a superlattice ceramic film.

24. A device made by the method described in claim 16.

* * * * *